US012629563B2

(12) United States Patent
Lieber

(10) Patent No.: US 12,629,563 B2
(45) Date of Patent: May 19, 2026

(54) VALVE FOR ADJUSTING THE GAS PRESSURE INSIDE A TENNIS BALL

(71) Applicant: John H. Lieber, Tulsa, OK (US)

(72) Inventor: John H. Lieber, Tulsa, OK (US)

( * ) Notice: Subject to any disclaimer, the term of this patent is extended or adjusted under 35 U.S.C. 154(b) by 7 days.

(21) Appl. No.: 19/028,745

(22) Filed: Jan. 17, 2025

(65) Prior Publication Data

US 2025/0276218 A1 Sep. 4, 2025

Related U.S. Application Data

(60) Provisional application No. 63/560,679, filed on Mar. 2, 2024.

(51) Int. Cl.
*A63B 41/00* (2006.01)

(52) U.S. Cl.
CPC ..... *A63B 41/00* (2013.01)

(58) Field of Classification Search
CPC ..... A63B 41/00; A63B 41/12; A63B 2102/02
See application file for complete search history.

(56) References Cited

U.S. PATENT DOCUMENTS 1,596,320 A * 8/1926 Sonnett ..... F16K 15/202 473/611
4,012,041 A * 3/1977 Hoffman ..... A63B 39/04 473/593
4,274,633 A * 6/1981 Benscher ..... A63B 41/04 473/610
9,173,430 B1 * 11/2015 Harvell ..... B01F 23/23611
9,816,630 B1 * 11/2017 Lieber ..... F16K 15/202
10,408,359 B2 * 9/2019 Landi, Jr. ..... B29C 49/4252

* cited by examiner

*Primary Examiner* — Patrick C Williams

(57) ABSTRACT

A repeatable use valve in a tennis ball that uses an inflation tube inserted into the valve opening to increase or decrease the pressure inside the ball. The increase or decrease in pressure will cause the ball to have respectively higher or lower bounce. The valve can be installed in new tennis balls at the time of manufacture. The valve can also be installed in used tennis balls, including used balls that have lost some or all of their original factory pressure.

1 Claim, 7 Drawing Sheets

VALVE FOR ADJUSTING THE GAS PRESSURE INSIDE A TENNIS BALL

BACKGROUND

Prior Art

There are several reasons why a tennis player might desire to increase or decrease the gas pressure inside a tennis ball:

1. After the passage of time, tennis balls lose pressure, even though most of the felt covering is still on the ball. This causes the balls to have less bounce and velocity and for many players this makes the game of tennis less enjoyable. Many players simply discard these "lost pressure" balls and purchase new ones. A method to quickly re-pressurize the balls that have lost pressure will extend the playing life of balls, thus saving the cost of buying new balls, saving the resources used to make new balls and saving the pollution of disposing of the discarded balls.
2. A newly manufactured tennis ball has a specified gas pressure, which causes the ball to have a specific bounce and velocity upon being struck by a racquet. A player may want to quickly increase the gas pressure inside the ball to increase the bounce of the ball and to increase the strike velocity. A player might do this in order to add more challenge, speed and excitement to the game, similar to some automobile owners modifying the "stock" engines of their vehicles to provide more power and speed. Other players may want to practice with "supercharged" balls to better prepare themselves for competition with other players who hit the balls with high velocity.
3. When playing tennis outdoors on cold days, ball have less bounce and velocity because the colder gas inside the ball exerts less pressure on the inside of the ball. A method to quickly increase gas pressure inside the ball will allow a player to have a ball with normal bounce and velocity on a cold day.
4. Some players may want to quickly decrease the gas pressure inside a tennis ball. In examples 2 and 3 above, a player may want to do so after finishing the activity when the increased pressure was desired. Beginning tennis players may want to decrease pressure in new tennis balls so the ball is easier to control or have lower velocity when struck by the racquet, and then increase pressure in the same ball as the player becomes more skilled. In high altitude locations, the factory gas pressure of normal tennis balls makes the balls bounce higher and with more velocity, which some players do not like. Manufacturers do make high altitude balls for this situation, but such balls might not always be available for purchase and they cannot be re-used by a player who may travel to a high altitude area and then return to a low altitude area. Being able to quickly adjust the gas pressure will enable to player to use the same balls in high altitude, low altitude and everywhere between.

Disadvantages of Current Methods

There are existing methods that claim to increase the gas pressure inside tennis balls. Most existing methods require tennis balls to be placed in a sealed container that has a higher gas pressure than the inside of the tennis ball. The marketers of these existing methods claim that, over time, the higher outside pressure gas will permeate the rubber of the ball and cause the inside pressure of the ball to increase. The disadvantages of this method include 1. It does not work with some balls.
2. The sealed containers can be expensive, costing from $20 to $5000.
3. The process, even if it works, is time consuming. It can take several days or more for the gas pressure inside the ball to reach a satisfactory level.
4. Because the method involves a high pressure container, there is a danger of explosion and injury.
5. Some of the apparatus cannot be operated by a lay person.
6. Some of the apparatus requires the use of a special gas instead of regular air.
7. These methods do not allow for decreasing the pressure inside a ball.

There are some patents that have been issued for methods of injecting air into tennis balls using a sharp syringe device that penetrates the rubber bladder of the tennis ball, similar to a hypodermic injection in a human. These methods can cause injury to the user, don't work well, and require new materials for each injection. There is a patent on a valve that uses a common sports ball inflation needle to inflate or deflate a tennis ball. That valve works, but sometimes it is difficult or time consuming to insert or withdraw the sports needle.

SUMMARY

The valve is made of rubber or other elastomer material. One embodiment describes a repeatable use valve in a tennis ball that uses an inflation tube pressed against the outside of the valve and surrounding ball felt to increase or decrease the pressure inside the ball. The increase or decrease in pressure will cause the ball to have respectively higher or lower bounce. To increase the pressure inside the tennis ball, an inflation tube as a source of positive pressure is pressed against the outside of the valve and surrounding ball felt. The force of the inflation tube against the valve and surrounding ball felt causes the surface of the tennis ball to become concave. When the surface of the tennis ball becomes concave, the valve allows air or other gas under positive pressure to flow through the valve and into the inside the tennis ball, thereby increasing the gas pressure inside the tennis ball. When the inflation tube is pulled away from the tennis ball, the surface of the tennis ball returns to its convex shape. When the surface of the tennis ball returns to its convex shape, the valve prevents any gas from escaping from the inside of the tennis ball. To decrease the pressure inside the tennis ball, the inflation tube is pressed against the outside of the valve and surrounding ball felt. The end of the inflation tube that is not pressed against the valve is open to the ambient air at atmospheric pressure. Thus, the pressure of the gas inside the tennis ball is greater than the pressure of the air outside the tennis ball. The force of the inflation tube against the valve and surrounding ball felt causes the surface of the tennis ball to become concave. When the surface of the tennis ball becomes concave, the valve allows the gas inside the tennis ball to flow through the valve, through the inflation tube and into the ambient air. When the inflation tube is pulled away from the tennis ball, the surface of the tennis ball returns to its convex shape. When the surface of the tennis ball returns to its convex shape, the valve prevents any more gas from escaping from the inside of the tennis ball into the ambient air.

Advantages

The valve described in this application overcomes all of the disadvantages of the prior art described above. The valve is a means in which the gas pressure inside a tennis ball can be safely and quickly increased or decreased, using regular air or a special gas, through a valve in the tennis ball that can be used repeatedly. The valve can be installed in new tennis balls at the time of manufacture. The valve can also be installed in used tennis balls that have lost some or all of their original factory pressure. The valve will extend the playing life of balls, thus saving the resources used to make new balls and saving the pollution of disposing of the discarded used balls.

DRAWINGS—BRIEF DESCRIPTION OF THE DRAWINGS

Figure 4:
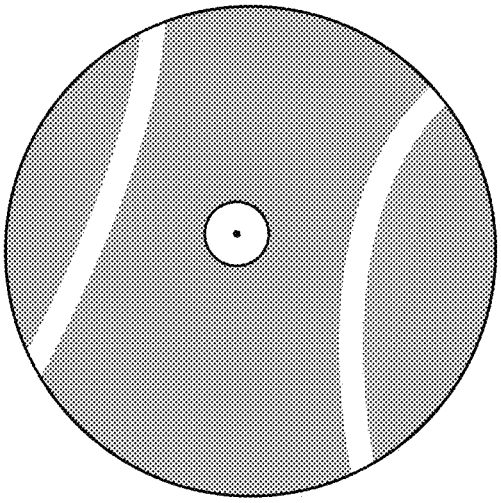

FIG. 4 is an overhead view of the valve installed in the tennis ball. It shows the valve opening. It also shows the outside flange of the valve surrounded by the felt cover of the tennis ball.

Figure 5:
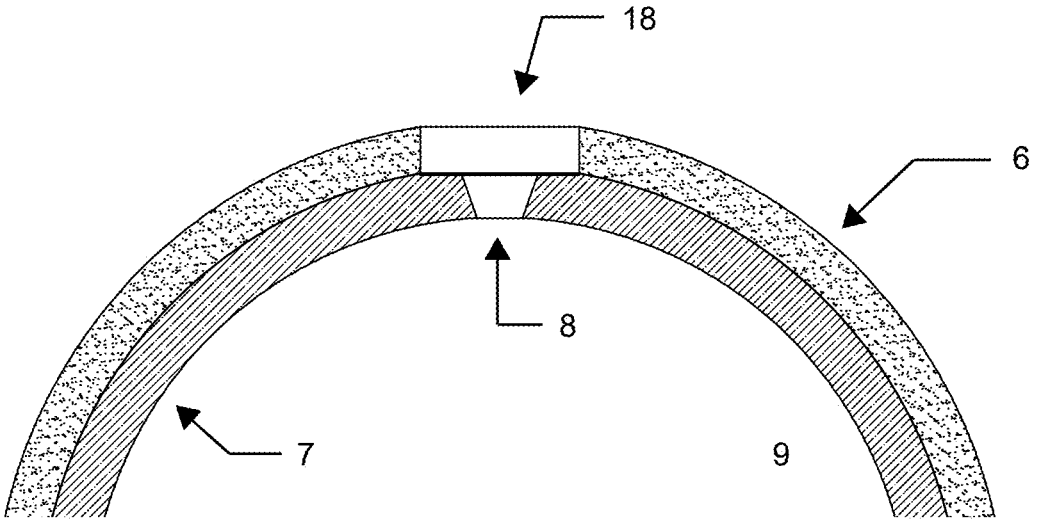

FIG. 5 is a cross section of a tennis ball in its usual convex shape. There is a hole in the tennis ball designed to accept installation of the valve. The shape of the hole in the ball rubber bladder is conical.

Figure 6:
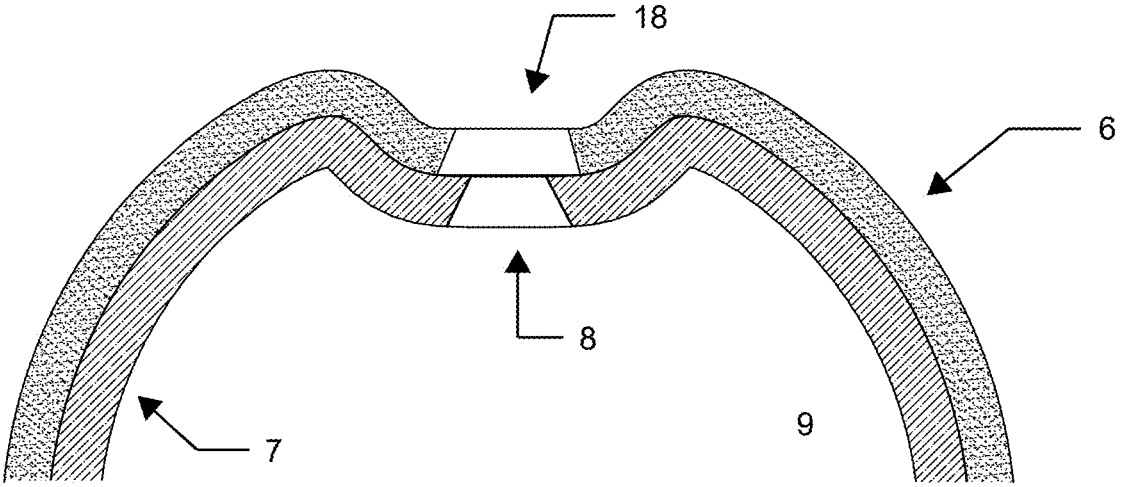

FIG. 6 is a cross section of the same tennis ball with the same conical hole in it. When the outside of the ball in the area of the ball hole is pressed inward, that portion of the ball deforms to a concave shape.

Figure 7:
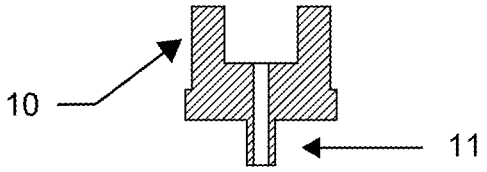

FIG. 7 is a cross section of a tube that is used with the valve to inflate and deflate the tennis ball. An example of such a tube would be a sports ball inflation needle with a needle that has been shortened. No patent is requested for the inflation tube.

Figure 8:
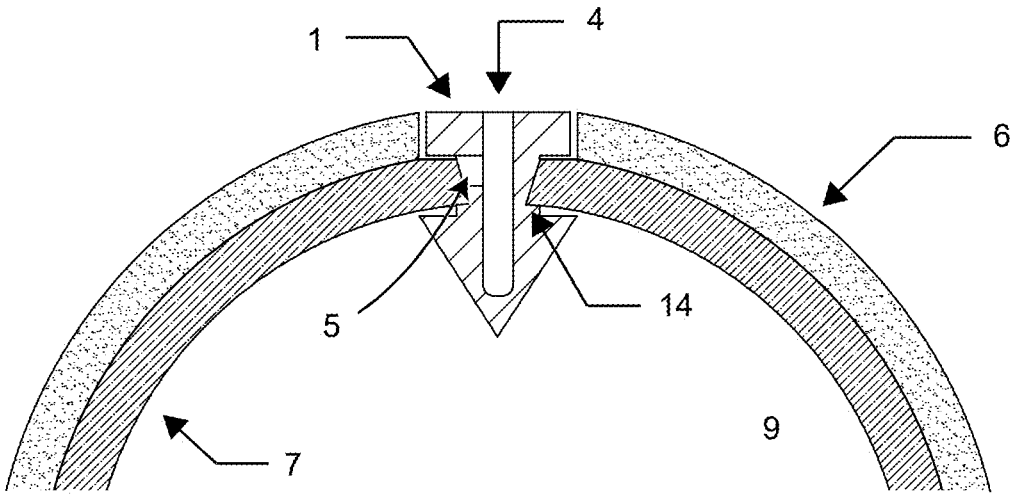

FIG. 8 is cross section of a convex surface tennis ball with the valve installed. Because the hole in the ball rubber bladder is conical, the bottom of the conical hole makes contact with the annular body of the valve.

Figure 9:
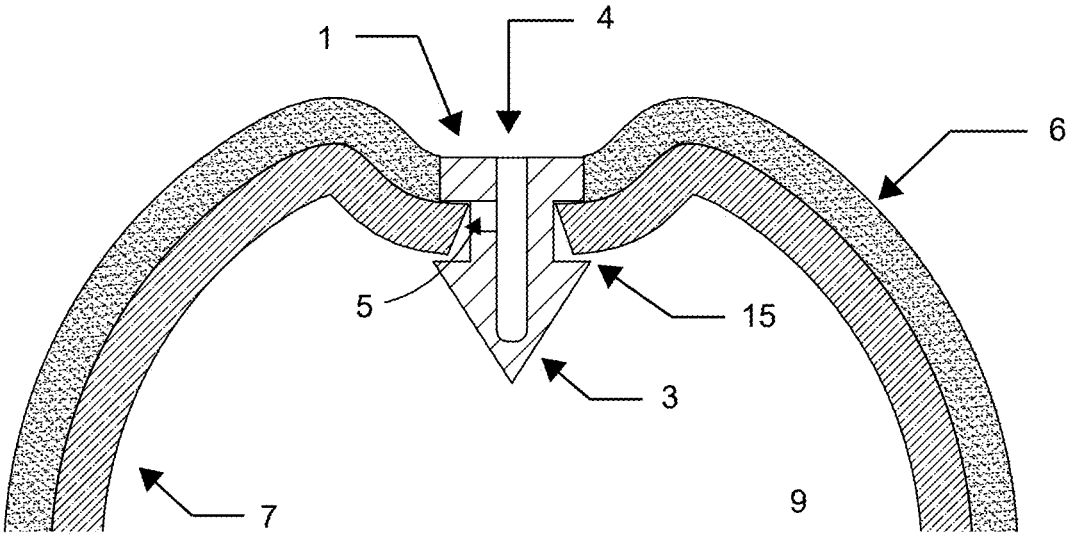

FIG. 9 is a cross section of a concave surface tennis ball with the valve installed. When the top of the ball deforms to a concave shape, the circumference of the bottom of the hole in the ball rubber bladder becomes larger than the circumference of the annular body of the valve.

Figure 10:
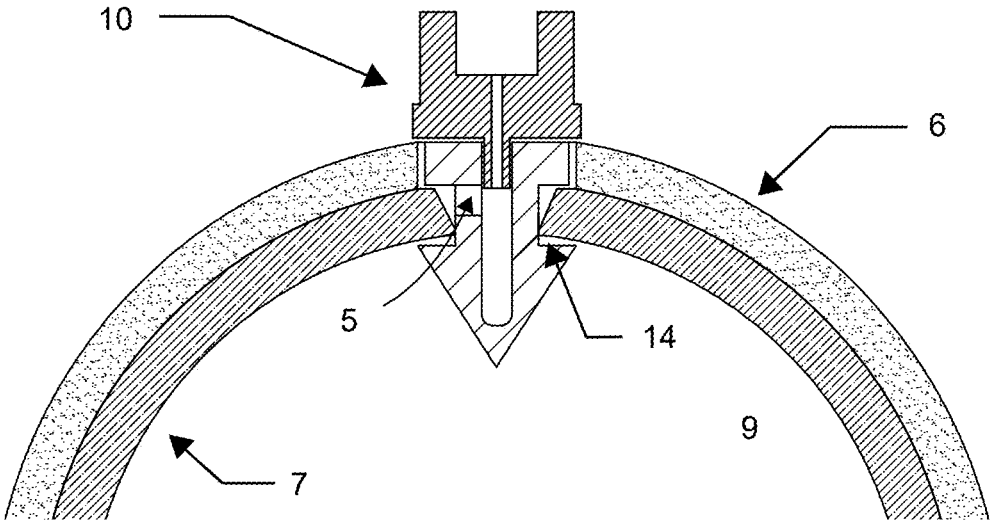

FIG. 10 is a cross section of the inflation tube pressed against the valve and surrounding ball felt when the surface of the tennis ball is convex.

Figure 11:
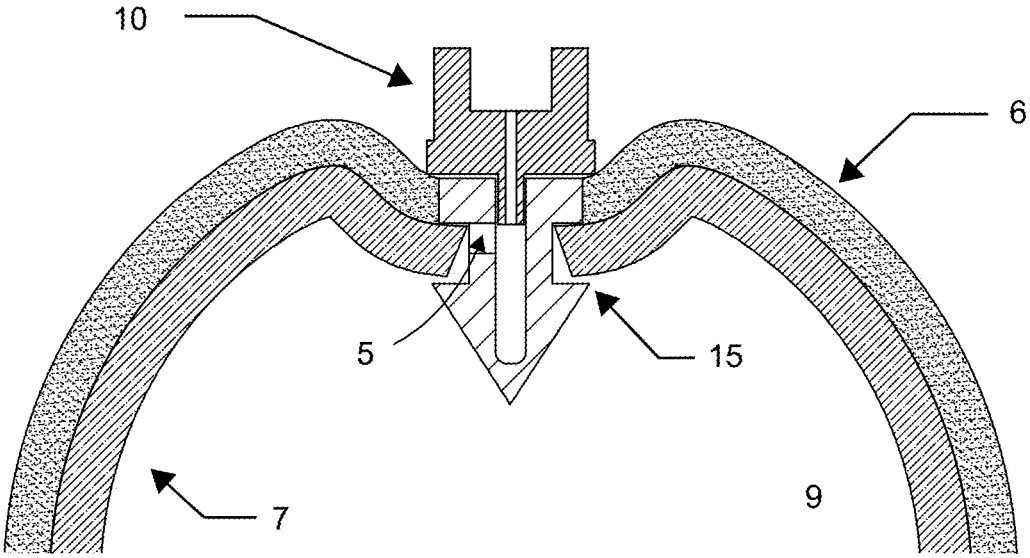

FIG. 11 is a cross section of the inflation tube pressed against the valve and surrounding ball felt when the surface of the tennis ball is concave. To make the surface concave, the inflation tube is used to press the valve and surrounding ball felt inward.

Figure 12:
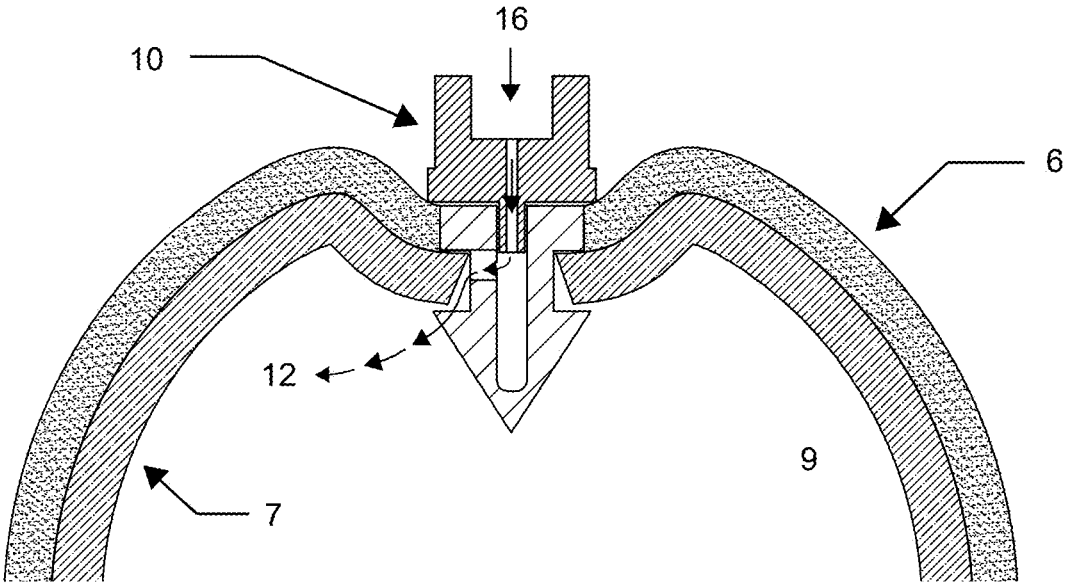

FIG. 12 is a cross section showing how the ball is inflated.

Figure 13:
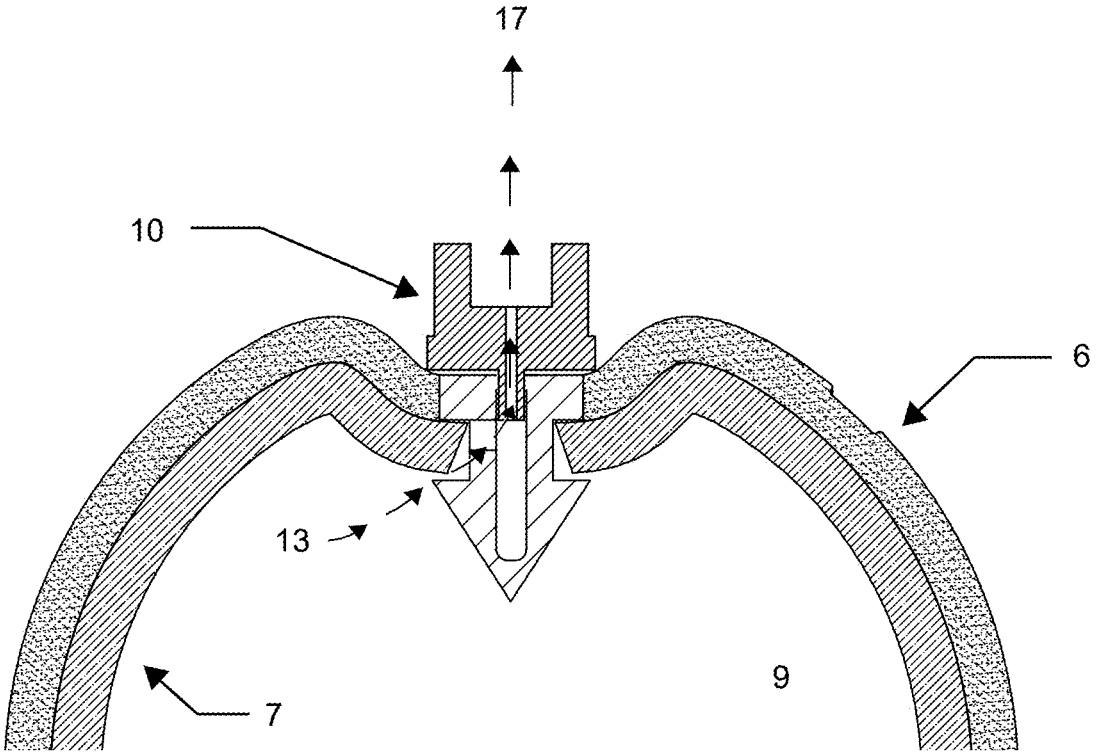

FIG. 13 is a cross section showing how the ball is deflated.

DETAILED DESCRIPTION

FIGS. 1 Through 13

REFERENCE NUMERAL LISTING

Figure 1:
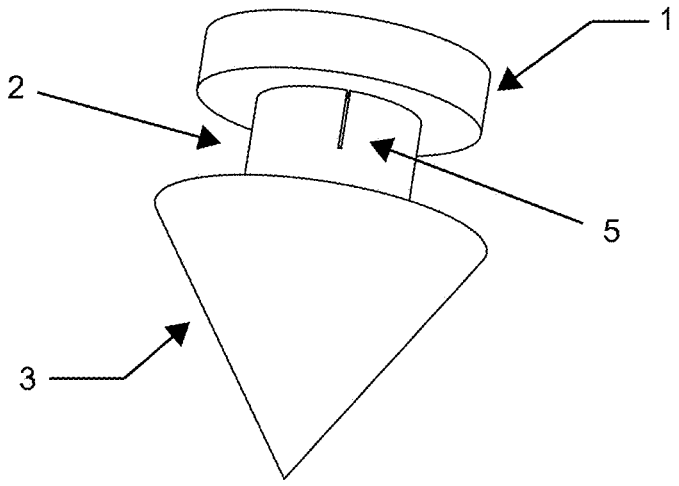
FIG. 1 is a three dimensional view showing the shape of the valve and the location of the opening in the annular body.

1—Outside Flange
2—Annular Body
3—Conical Flange
4—Valve Opening
5—Opening in Annular Body
6—Ball Felt
7—Ball Rubber Bladder
8—Conical Hole in Ball Rubber Bladder
9—Interior Space of Tennis Ball
10—Inflation Tube
11—Needle Head of Inflation Tube
12—Direction and Location of Gas Flow During Ball Inflation
13—Direction and Location of Gas Flow During Ball Deflation
14—Bottom of Conical Hole Pinches the Annular Body
15—Bottom of Conical Hole Allows Flow of Gas
16—Source of Positive Air Pressure
17—Atmospheric Air Pressure
18—Hole in Tennis Ball Felt FIG. 1 is a three dimensional view showing the shape of the valve and the location of the opening in the annular body. The valve is made of rubber or other elastomer material.

Figure 2:
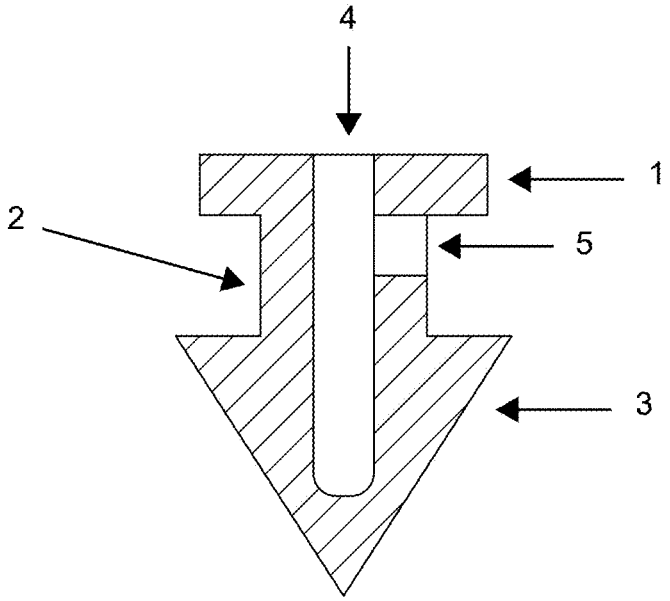
FIG. 2 is a cross section of the parts of the valve.

FIG. 2 is a cross section of the parts of the valve. The portion of the figure with diagonal lines show the rubber part of the valve. Air or other gas can flow from the valve opening, through the opening in the annual body, to the space outside the annular body.

Air or other gas can also flow from the space outside the annular body, through the opening in the annular body, to the valve opening.

Figure 3:
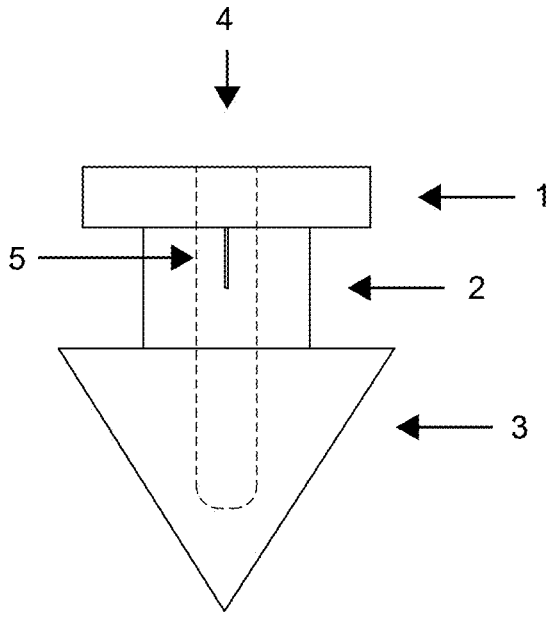
FIG. 3 is another cross section of the parts of the valve.

FIG. 3 is another cross section of the parts of the valve. The dashed lines how the valve opening hole extends down through the middle of the annular body and into the conical flange.

FIG. 4 is an overhead view of the valve installed in the tennis ball. It shows the valve opening. It also shows the outside flange of the valve surrounded by the felt cover of the tennis ball.

FIG. 5 is a cross section of a tennis ball in its usual convex shape. There is a hole in the tennis ball designed to accept installation of the valve. There is a hole in the tennis ball felt and a hole in the tennis ball rubber bladder. The shape of the hole in the tennis ball rubber bladder is conical, with the wider diameter of the cone on the outside of the ball rubber. The smaller diameter of the conical hole in the ball rubber is on the inside of the ball rubber.

FIG. 6 is a cross section of the same tennis ball with the same conical hole in it. When the outside of the ball in the area of the valve and surrounding ball felt is pressed inward, that portion of the ball deforms to a concave shape. When this area of the ball deforms to a concave shape, the shape of the conical hole in the ball rubber bladder changes because the ball rubber is an elastomer. The circumference of the hole in the inside of the ball rubber bladder becomes larger.

FIG. 7 is a cross section of a tube that is used with the valve to inflate and deflate the tennis ball. The tube has a cylindrical body with two connected cylindrical components that conduct the flow of air or other gas. The needle head of the tube is the smaller diameter cylindrical component. Air or other gas can flow in both directions through the tube. An example of such a tube would be a common sports ball inflation needle with a needle that has been shortened.

FIG. 8 is a cross section of a convex surface tennis ball with the valve installed. Because the hole in the ball rubber bladder is conical, the bottom of the conical hole makes contact with the annular body of the valve. The bottom of the hole in the ball rubber bladder "pinches" the annular body of the valve and forms a seal between the valve and the air space inside the tennis ball.

FIG. 9 is a cross section of a concave surface tennis ball with the valve installed. When the area of the ball where the valve is installed deforms to a concave shape, the circumference of the bottom of the hole in the ball rubber bladder becomes larger than the circumference of the annular body of the valve. There is no seal between the valve and the air space inside the tennis ball. Because there is no seal, gas can flow into and out of the interior space of the tennis ball. The path of the gas going into and out of the interior space is through the inflation tube, through the valve opening, through the opening in the annular space, and through the bottom of the hole in the ball rubber bladder.

FIG. 10 is a cross section showing the inflation tube pressed against the valve and surrounding ball felt when the surface of the tennis ball is convex. The needle head is inserted into the valve opening. The diameter of the inflation tube is larger than the diameter of the outside flange of the valve.

FIG. 11 is a cross section showing the inflation tube pressed against the valve when the surface of the tennis ball is concave. To make the surface concave, the inflation tube is used to press the valve and surrounding ball felt surface inward.

FIG. 12 is a cross section showing what happens when the ball is inflated. The inflation tube is used to press the valve and surrounding ball felt inward. When the ball surface becomes concave the circumference of the bottom of the hole in the ball rubber bladder becomes larger. The circumference of the bottom of the ball hole in the ball rubber bladder becomes greater than the circumference of the annular body. Under positive gas pressure going through the inflation tube, the gas goes through the inflation tube, through the valve opening, through the opening in the annular body, through the bottom of the hole in the ball rubber bladder and into the interior of the tennis ball, thereby inflating the tennis ball. When there is sufficient gas in the ball, the inflation tube is pulled away from the ball. The top of the tennis ball returns to its convex shape. The circumference of the bottom of the hole in the ball rubber bladder gets smaller and pinches the lower portion of the annular body of the valve. This prevents any of the new gas inside the tennis ball from escaping.

FIG. 13 is a cross section showing how the ball is deflated. When the ball has more than the desired pressure, the gas pressure inside the ball is greater than atmospheric air pressure. The top of the inflation tube is left open so that the top of the inflation tube is at atmospheric air pressure. The inflation tube is used to press the valve and surrounding ball felt inward. When the ball surface becomes concave the circumference of the bottom of the hole in the ball rubber bladder becomes larger. The circumference of the bottom of the hole in the ball rubber bladder is greater than the circumference of the annular body. Under positive gas pressure from the inside of the ball, the gas goes through the bottom of the hole in the ball rubber, through the opening in the annular body of the valve, through the valve opening, through the inflation tube and into the atmosphere. When sufficient gas pressure inside the ball has been reduced, the inflation tube is pulled away from the ball. The top of the tennis ball returns to its convex shape. The circumference of the bottom of the hole in the ball rubber bladder becomes smaller and pinches the lower portion of the annular body of the valve. This prevents any more of the gas inside the tennis ball from escaping.

Operation

After the valve has been installed in the tennis ball, the inflation tube is used to inflate of deflate the ball. To inflate the ball, positive gas pressure is connected to the wider end of the inflation tube. A hand pump or an air compressor can be used to provide positive gas pressure. The needle head of the inflation tube is inserted into the valve opening. The inflation tube is pressed against the valve and surrounding ball felt to cause the surface shape of the ball in the area of the valve to change from convex to concave. This causes gas to flow from the inflation tube, through the valve and into the interior space of the ball. When the user determines that the ball has sufficient pressure, the user withdraws the inflation tube from the ball, so that the surface of the ball becomes convex. To deflate the ball, the wider end of the inflation tube is left open to ambient air pressure. The needle head of the inflation tube is inserted into the valve opening. The inflation tube is pressed against the valve and surrounding ball felt to cause the surface shape of the ball in the area of the valve to change from convex to concave. This causes gas to flow from the interior space of the ball, through the valve, through the tube and into the atmosphere. When the user determines that the ball has lost sufficient pressure, the user withdraws the inflation tube from the ball, so that the surface of the ball becomes convex. Air compressors, gauges and other commonly available equipment can be used to make the process quicker or more uniform and precise.

It is necessary to make the hole in the tennis ball and then install the valve in the hole. The hole can be drilled in the felt and rubber using a combination of commonly available drills and bits. To install the valve, it is necessary to lubricate the conical flange and then push the conical flange into the ball hole. The conical flange then passes through the ball rubber bladder and the annular space of the valve rests in the conical hole in the ball rubber bladder. The valve can also be molded or otherwise installed through some other process at the time of manufacture.

CONCLUSION, RAMIFICATIONS AND SCOPE

The reader will see that the valve provides a more safe, simple, quick, inexpensive and repeatable method of increasing or decreasing the pressure of a tennis ball. The valve can be installed in new or used tennis balls.

Although the above description contains many specificities, these should not be construed at limiting the scope of this patent. The scope of the valve should be determined by the appended claims and their legal equivalents, rather than the examples given. The valve is not limited to tennis balls. It can be used for other sports balls. It can be also used or installed in other applications involving the flow of gas or liquids in and out of tanks, pipelines pressure vessels, etc.

I claim:

1. A valve made of an elastomer material configured to be installed in a tennis ball for the purpose of allowing gas to enter and exit an interior space of said tennis ball with the use of an inflation tube, said valve comprising a) an outside cylindrical flange portion having an upper surface b) an annular body portion adjacent to said outside flange portion, said annular body portion having a diameter which is smaller than the diameter of said outside flange portion c) a conical flange portion adjacent to said annular body, which said conical flange portion has the larger circle of the cone being larger in diameter than the diameter of said annular body portion and located adjacent to said annular body portion d) a hole extending through a central axis of the outside flange portion, said annular body portion and into said conical flange portion e) an opening in said annular body that allows for the passage of gas or liquid from the inside of said hole to the outside of said annular body, and also allows for the passage of gas or liquid from the outside of said annular body to the inside of said hole, whereby said valve is configured to be installed through a countersunk hole in a tennis ball, such that the upper surface of said outside flange portion is configured to be even with the outer surface of the felt layer of a tennis ball, said annular body portion is configured to make contact with a conical hole in a rubber layer of a tennis ball, the larger circle of said conical flange portion is configured to be situated against or near the inside rubber surface of a tennis ball, so that when tube with a needle head is inserted into the valve opening and pressed inward, the surface of the tennis ball changes shape from convex to concave, the diameter of the conical hole on the inside of the ball rubber increases in circumference, gas flows into and out of the interior space of the tennis ball by traveling through the inflation tube, through the valve opening, through the opening in the valve annular body, through the bottom of the hole in the ball rubber, and when the tube is withdrawn, the flow of gas ceases because the surface of the tennis ball returns to its convex shape, the circumference of the bottom of the hole in the ball rubber becomes so much smaller that it prevents any flow of gas from the bottom of the hole in the ball rubber, thereby ceasing any flow of gas through the opening the annular body, with no corresponding flow of gas through the valve opening.

* * * * *